US008731443B2

(12) United States Patent
Mihara et al.

(10) Patent No.: US 8,731,443 B2
(45) Date of Patent: May 20, 2014

(54) DEVELOPING DEVICE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 141 days.

(21) Appl. No.: 13/444,422

(22) Filed: Apr. 11, 2012

(65) Prior Publication Data

US 2012/0328334 A1 Dec. 27, 2012

(30) Foreign Application Priority Data

Jun. 27, 2011 (JP) ..... 2011-141933

(51) Int. Cl.
*G03G 15/08* (2006.01)

(52) U.S. Cl.
USPC ..... 399/254; 399/256

(58) Field of Classification Search
USPC ..... 399/254, 255, 256
See application file for complete search history.

(56) References Cited

U.S. PATENT DOCUMENTS

| | | | | |
|---|---|---|---|---|
| 8,213,836 | B2 | 7/2012 | Kato et al. | 399/254 |
| 2001/0021324 | A1 | 9/2001 | Sugihara | 399/254 |
| 2009/0214266 | A1* | 8/2009 | Kato et al. | 399/254 |
| 2011/0286770 | A1* | 11/2011 | Hayashi et al. | 399/254 |
| 2011/0318062 | A1* | 12/2011 | Hayashi et al. | 399/254 |
| 2012/0045252 | A1* | 2/2012 | Mihara et al. | 399/254 |
| 2012/0155923 | A1* | 6/2012 | Yoshida | 399/254 |

FOREIGN PATENT DOCUMENTS

| | | |
|---|---|---|
| JP | 08-220887 | 8/1996 |
| JP | 2007-310098 | 11/2007 |
| JP | 2008-15549 | 1/2008 |
| JP | 2009-109741 | 5/2009 |
| JP | 2009-198760 | 9/2009 |

* cited by examiner

*Primary Examiner* — Sophia S Chen
(74) *Attorney, Agent, or Firm* — Nixon & Vanderhye, P.C.

(57) ABSTRACT

A developing device has a first and a second developer conveyance path configured to convey and circulate the two-component developer; a first and a second conveyance member each having a helical blade for conveying the developer in one direction; a first communicating path for guiding the developer in the first developer conveyance path to the second developer conveyance path; a second communicating path. The second developer conveyance path includes a second upstream side end section having a bottom in a conical shape having an inner diameter conically increasing. The helical blade of the second conveyance member has a second conical helix portion having an outer diameter conically increasing along an inner wall surface of the bottom of the second upstream side end section. The bottom of the second upstream side end section is at a level lower than a bottom of the first developer conveyance path.

7 Claims, 9 Drawing Sheets

DEVELOPING DEVICE AND IMAGE FORMING APPARATUS

CROSS-REFERENCE TO RELATED APPLICATION

This application is related to Japanese Patent Application No. 2011-141933 filed on Jun. 27, 2011, whose priority is claimed under 35 USC §119, and the disclosures of which are incorporated by reference in its entirety.

BACKGROUND OF THE INVENTION

1. Field of the Invention

The present invention relates to a developing device and an image forming apparatus. More particularly, the present invention relates to a developing device with the use of a two-component developer including a toner and a magnetic carrier, and an image forming apparatus such as an electrostatic copying machine, a laser printer and a facsimile machine that form images using the developing device by an electrophotographic method.

2. Description of the Related Art

In the image forming apparatus using the electrophotographic method, an electrostatic latent image is formed on the surface of a photoconductor drum (toner image holder), a toner is supplied to the photoconductor drum by means of a developing device to develop the electrostatic latent image, a toner image formed on the photoconductor drum through the development is transferred onto a sheet such as a paper sheet, and the toner image is fused onto the sheet by means of a fuser.

In recent years, for a full-color compliant and high-definition compliant image forming apparatus, a two-component developer (hereinafter, may be referred to simply as "developer") has been widely used, which is excellent in toner charging stability. The developer includes a toner and a magnetic carrier. The toner and the carrier are agitated in a developing device to generate friction between the toner and the magnetic carrier, and the friction allows the toner to be appropriately charged.

The charged toner is supplied to a surface of a developer holder such as a developing roller. The toner supplied to the developing roller is transferred to an electrostatic latent image formed on a photoconductor drum by electrostatic attraction. Thus, a toner image based on the electrostatic latent image is formed on the photoconductor drum.

Further, such an image forming apparatus is required to be more high-speed and downsized. It is therefore necessary to quickly perform sufficient charging of a developer and to quickly convey the developer.

To this end, as a today's image forming apparatus, there has been proposed an image forming apparatus including a circulative developing device in order to instantly disperse supplementary toner into a developer to give an appropriate amount of charge.

The circulative developing device, as disclosed in Japanese Unexamined Patent Application Publication No. 2001-255723, for example, has two conveyance paths and two conveyance screws in a developer case, in which the conveyance paths allow a two-component developer to be conveyed and circulated therethrough, and the conveyance screws are respectively disposed in the conveyance paths to simultaneously agitate and convey the two-component developer.

The developer is conveyed toward one end by one of the conveyance screws (second conveyance screw), and then conveyed toward the other end by the other conveyance screw (first conveyance screw) to be circulated under agitation. The first and second conveyance screws are configured to have different numbers of screw spirals to improve the dispersibility of the developer in a direction toward a developing roller and obtain stable and good image quality.

In addition, Japanese Unexamined Patent Application Publication No. 2009-109741 proposes a developing device including, in a housing for containing a developer, a first agitation and conveyance screw, a second agitation and conveyance screw, and a developing roller, wherein the first and second agitation and conveyance screws each have a helical blade and a reverse helical blade having a phase (pitch) moving reversely to the helical blade, and the reverse helical blade is disposed at an downstream side end of the screw in the developer conveyance direction and has a through hole.

In this developing device, each reverse helical blade reversely conveys the developer and returns the developer through the through hole to generate convection in the developer near the reverse helical blade, so that the developer in the dead space is agitated efficiently and generation of a pool of the developer is prevented.

In the above-described conventional developing device, however, the developer turns at a right angle at a downstream side end of one conveyance screw to move toward an upstream side end of the other conveyance screw. Upon the turning, some developer fails to turn at a right angle and has nowhere else to go to stay at the downstream side end.

Since the developer is pushed only in a rotation axis direction by rotation of the conveyance screw, the developer conveyed to the downstream side end of the conveyance path and the developer, having nowhere else to go, stays at an inner wall of the housing of the developer tank or just before the reverse helical blades push against each other, and as a result, the pressure on the developer is rapidly increased.

Once the pressure is increased, the developer at the downstream side end will continue to receive the pushing force (stress) by the conveyance screw in the rotation axis direction, while the velocity component of the developer in the rotation axis direction is zero.

That is, the developer staying at the inner wall of the housing or just before the reverse helical blade will receive a shear force, while being compressed.

As a result, a toner flow improver included in the toner as an external additive is buried in the toner surface due to heat generated by the stress and the shear force to significantly reduce the flowability of the developer, causing a lowered image density.

That is, when the developer is subjected to stress, the flow improver buried in the toner surface reduces the flowability of the developer to hinder the conveyance of the developer itself. As a result, the photoconductor drum is prevented from being supplied with a sufficient amount of developer via the developing roller to lead to a lowered density of an image printed on a recording medium.

SUMMARY OF THE INVENTION

The present invention is a developing device, comprising: a developer tank for containing a two-component developer; a partition for partitioning an internal space of the developer tank; a first developer conveyance path and a second developer conveyance path separated by the partition and configured to convey and circulate the two-component developer in pairs; a first conveyance member and a second conveyance member provided in the first and second developer conveyance paths, respectively, in a freely rotatable manner, the first and second conveyance members each having a helical blade for conveying the two-component developer in one direction; a first communicating path for guiding the two-component developer in the first developer conveyance path to the second developer conveyance path; a second communicating path for guiding the two-component developer in the second developer conveyance path to the first developer conveyance path; a developing roller for bearing and supplying the two-component developer in the first developer conveyance path to a photoconductor drum; and a toner supply port for supplying new toner into the developer tank, wherein the second developer conveyance path includes a second central section and a second upstream side end section having a bottom in a conical shape having an inner diameter conically increasing toward an upstream side of the two-component developer conveyance direction from the second central section in the vicinity of the first communicating path, the helical blade of the second conveyance member has, in the second upstream side end section of the second conveyance path, a second conical helix portion having an outer diameter conically increasing along an inner wall surface of the bottom of the second upstream side end section toward the upstream side of the two-component developer conveyance direction, and the bottom of the second upstream side end section is at a level lower than a bottom of the first developer conveyance path in the vertical direction at a position facing the first communicating path.

According to the aspect of the present invention, the bottom of the second upstream side end section of the second developer conveyance path is at a level lower than the bottom of the first developer conveyance path in the vertical direction at the position facing the first communicating path, and therefore the developer that has been conveyed to the downstream side of the first developer conveyance path whose bottom is at a higher level is caused to path through the first communicating path and swiftly flow into the second developer conveyance path whose bottom is at a lower level. It is thereby possible to improve the flow of the developer and reduce stay of the two-component developer and stress on the two-component developer around the first communicating path.

DESCRIPTION OF THE PREFERRED EMBODIMENTS

Figure 1:
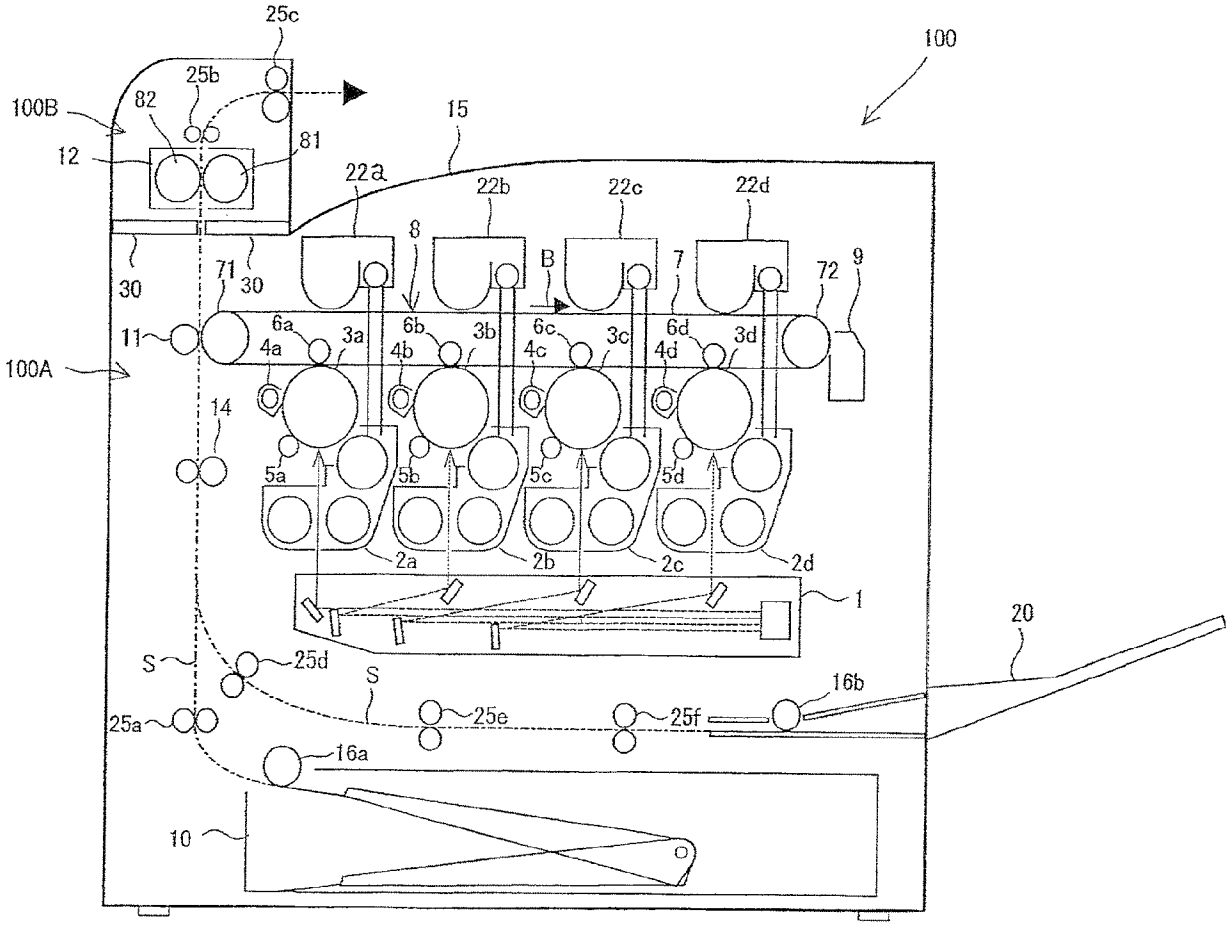
FIG. 1 is an explanatory diagram illustrating a general configuration of an embodiment of an image forming apparatus of the present invention.

It is an object of the present invention to provide: a developing device capable of preventing rapid increase in pressure on a developer being conveyed and circulated and of reducing stress on the developer at downstream sides of two developer conveyance paths; and an image forming apparatus including the developing device.

In the developing device of the present invention, the first developer conveyance path has a first central section and a first downstream side end section having a downslope from the first central section in the vicinity of the first communicating path toward a downstream side of the two-component developer conveyance direction in a direction of a rotation axis of the first conveyance member.

According to the aspect of the present invention, the first developer conveyance path has a downslope in the vicinity of the first communicating path in the direction of the rotation axis of the first conveyance member, and therefore the two-component developer that has been conveyed to the downstream side of the first developer conveyance path can easily move toward the first downstream side end section of the first developer conveyance path to be prevented from staying at the first downstream side end section of the first developer conveyance path.

In the developing device of the present invention, the first downstream side end section has a downslope from the first developer conveyance path toward the second developer conveyance path in a direction perpendicular to the rotation axis of the first conveyance member.

According to the aspect of the present invention, the first downstream side end section has a downslope from the first developer conveyance path toward the second developer conveyance path in the vicinity of the first communicating path, and therefore the two-component developer that has been conveyed to the downstream side of the first developer conveyance path can easily move toward the second developer conveyance path to be prevented from staying at the first communicating path.

In the developing device of the present invention, the first developer conveyance path includes a first upstream side end section having a bottom in a conical shape having an inner diameter conically increasing toward an upstream side of the two-component developer conveyance direction from the first central section in the vicinity of the second communicating path, the helical blade of the first conveyance member has a first conical helix portion having an outer diameter conically increasing along an inner wall surface of a bottom of the first upstream side end section toward the upstream side of the two-component developer conveyance direction, and the bottom of the first upstream side end section is at a level lower than a bottom of the second developer conveyance path in the vertical direction at a position facing the second communicating path.

According to the aspect of the present invention, the bottom of the first upstream side end section of the first developer conveyance path is at a level lower than the bottom of the second developer conveyance path in the vertical direction at the position facing the second communicating path, and therefore the developer that has been conveyed to the downstream side of the second developer conveyance path whose bottom is at a higher level is caused to path through the second communicating path and swiftly flow into the first developer conveyance path whose bottom is at a lower level. It is thereby possible to improve the flow of the developer and reduce stay of the two-component developer and stress on the two-component developer around the second communicating path.

In the developing device of the present invention, the second developer conveyance path includes a second downstream side end section having a downslope from the second central section in the vicinity of the second communicating path toward a downstream side of the two-component developer conveyance direction in a direction of a rotation axis of the second conveyance member.

According to the aspect of the present invention, the second developer conveyance path has a downslope in the vicinity of the second communicating path in the direction of the rotation axis of the second conveyance member, and therefore the two-component developer that has been conveyed to the downstream side of the second developer conveyance path can easily move toward the second downstream side end section of the second developer conveyance path to be prevented from staying at the second downstream side end section of the second developer conveyance path.

In the developing device of the present invention, the second downstream side end section has a downslope from the second developer conveyance path toward the first developer conveyance path in a direction perpendicular to the rotation axis of the second conveyance member.

According to the aspect of the present invention, the second downstream side end section has a downslope from the second developer conveyance path toward the first developer conveyance path in the vicinity of the second communicating path, and therefore the two-component developer that has been conveyed to the downstream side of the second developer conveyance path can easily and swiftly move toward the first developer conveyance path to be prevented from staying at the second communicating path.

In the developing device of the present invention, the toner supply port is provided in the vicinity of the first communicating path and at an upper part of the first downstream side end section in the vertical direction.

According to the aspect of the present invention, the toner supply port is provided at an upper part of the first downstream side end section of the first developer conveyance path, and therefore the supplementary toner supplied through the toner supply port will be mixed with the two-component developer in a plurality of steps, that is, mixed with some of the two-component developer conveyed to the first downstream side end section of the first developer conveyance path, conveyed to the second upstream side end section of the second developer conveyance path, and then mixed with the two-component developer that has flowed into the second developer conveyance path through the first communicating path. It is therefore possible to improve the miscibility between the supplementary toner and the two-component developer, and prevent the two-component developer from being conveyed while having the supplementary toner floating thereon.

The present invention is a image forming apparatus, comprising: a photoconductor drum having a surface on which an electrostatic latent image is formed; a charger for charging the surface of the photoconductor drum; an exposure device for forming the electrostatic latent image on the surface of the photoconductor drum; a toner supplying device for supplying a toner to the developing device; a transfer device for transferring, to a recording medium, a toner image formed on the surface of the photoconductor drum by the developing device with the toner supplied from the toner supplying device; and a fixing device for fixing the transferred toner image onto the recording medium.

According to the aspect of the present invention, the image forming apparatus includes the developing device having the above-described characteristics, and therefore the flow of the two-component developer is improved to reduce stay of the two-component developer and stress on the two-component developer. Thus, the image forming apparatus can form images of a stable quality over a long period of time.

Hereinafter, embodiments of a developing device and an image forming apparatus of the present invention will be described in detail with reference to the drawings. It should be noted that the present invention is not limited to the embodiments.

[Configuration of Image Forming Apparatus]

FIG. 1 is an explanatory diagram illustrating a general configuration of an embodiment of an image forming apparatus including a developing device of the present invention.

An image forming apparatus 100 mainly comprises: a developing device housing 100A accommodating a plurality of developing devices 2*a* to 2*d* in a casing; a fuser housing 100B accommodating a fuser (fixing device) 12 above the developing device housing 100A in the casing; and a partition 30 provided between the developing device housing 100A and the fuser housing 100B to insulate heat of the fuser 12 to prevent the heat from being transferred to a developing device side.

The image forming apparatus 100 forms a multicolor or monochrome image on a sheet-like recording medium (recording paper) according to image data transmitted from an external source. An upper surface of the developing device housing 100A, located beside the fuser housing 100B in FIG. 1, constitutes a sheet exit tray 15.

In the embodiment in FIG. 1, the image forming apparatus is a printer by way of example. Alternatively, the image forming apparatus may be a copying machine, a facsimile machine or a multifunctional system having these functions, which can form a multicolor or monochrome image on a recording medium according also to externally-transmitted image data and/or image data scanned from a document by a scanner.

[Configuration of Developing Device Housing 100A]

As illustrated in FIG. 1, the developing device housing 100A includes: four photoconductor drums 3*a*, 3*b*, 3*c* and 3*d*; four chargers (charging devices) 5*a*, 5*b*, 5*c* and 5*d* for charging surfaces of the respective photoconductor drums 3*a* to 3*d*; an exposure unit (exposure device) 1 for forming electrostatic latent images on the surfaces of the respective photoconductor drums 3*a* to 3*d*; the four developing devices 2*a*, 2*b*, 2*c* and 2*d* for individually containing black, cyan, magenta and yellow toners and developing the electrostatic latent images on the surfaces of the respective photoconductor drums 3*a* to 3*d* to form toner images; four cleaner units 4*a*, 4*b*, 4*c* and 4*d* for removing residual toners left on the surfaces of the respective photoconductor drums 3*a* to 3*d* after the development and the image transfer; four toner supplying devices 22*a*, 22*b*, 22*c* and 22*d* for individually supplying the four colors of toners to the respective developing devices 2*a* to 2*d*; an intermediate transfer belt unit (transfer device) 8 for transferring the toner images on the surfaces of the respective photoconductor drums 3*a* to 3*d* to a recording medium; and an intermediate transfer belt cleaning unit 9.

The reference numeral a represents members for black image formation, the reference numeral b represents members for cyan image formation, the reference numeral c represents members for magenta image formation, and the reference numeral d represents members for yellow image formation.

In the image forming apparatus 100, a black toner image, a cyan toner image, a magenta toner image and a yellow toner image are selectively formed on the surfaces of the photoconductor drums 3*a*, 3*b*, 3*c* and 3*d* based on image data of the four color components of black (K), cyan (C), magenta (M) and yellow (Y), respectively. The toner images formed are superimposed on each other on the intermediate transfer belt unit 8 to form one color image on a recording medium.

Hereinafter, the photoconductor drums 3*a* to 3*d* corresponding to the respective colors will be collectively described with a reference numeral 3 as having the same configuration. Likewise, the developing devices will be denoted by a reference numeral 2, the chargers will be denoted by a reference numeral 5, the cleaner units will be denoted by a reference numeral 4, and the toner supplying devices will be denoted by a reference numeral 22 in the following description.

The developing device, which constitutes a characteristic configuration of the present invention, will be described later.

The photoconductor drum 3 includes a conductive base body and a photoconductive layer formed on a surface of the base body, and the photoconductor drum 3 is a cylindrical member that forms a latent image by charge and exposure. The photoconductor drum 3 exhibits a conductive property in response to exposure to light, and an electric image called electrostatic latent image is formed on the surface thereof. The photoconductor drum 3 is supported by drive means, not shown, such that it can rotate about its axis.

Under the photoconductor drum 3, disposed are the four developing devices for forming images in the different colors.

The cleaner unit 4 removes and collects toner left on the surface of the photoconductor drum 3 after development and image transfer processes.

The charger 5 is to uniformly charge the surface of the photoconductor drum 3 at a predetermined potential. As the charger 5, a contact brush type charger, a non-contact type charger, or the like may be used other than the contact roller type charger shown in FIG. 1.

The exposure unit 1 applies light according to image data to the surface of the charged photoconductor drum 3 from below the charger 5 and the developing device 2 to perform exposure, thereby forming an electrostatic latent image according to the image data on the surface of the photoconductor drum 3.

In the present embodiment, as illustrated in FIG. 1, the exposure unit 1 is a laser scanning unit (LSU) that includes a laser irradiation section and reflective mirrors. Alternatively, an EL (electroluminescence) or LED writing head in which light emitting elements are arranged in an array may be used.

The exposure unit 1 is disposed under the developing device 2.

The intermediate transfer belt unit 8 includes: intermediate transfer rollers 6*a*, 6*b*, 6*c* and 6*d* (hereinafter, collectively described with a reference numeral 6); an intermediate transfer belt 7; an intermediate transfer belt driving roller 71; an intermediate transfer belt driven roller 72; and an intermediate transfer belt tension mechanism, not shown.

The intermediate transfer roller 6, the intermediate transfer belt driving roller 71, the intermediate transfer belt driven roller 72 and the intermediate transfer belt tension mechanism allow the intermediate transfer belt 7 to lay across in a tensioned condition, and allow the intermediate transfer belt 7 to be driven to rotate in a direction of an arrow B in FIG. 1.

The intermediate transfer roller 6 is rotatably supported at intermediate transfer roller attaching parts of the intermediate transfer belt tension mechanism in the intermediate transfer belt unit 8. A transfer bias is applied on the intermediate transfer roller 6 in order to transfer a toner image from the photoconductor drum 3 onto the intermediate transfer belt 7.

The intermediate transfer belt 7 is disposed so as to be in contact with each photoconductor drum 3. Toner images of the respective color components formed on the photoconductor drum 3 are sequentially transferred to and superimposed on the intermediate transfer belt 7 to form a color toner image (multicolor toner image). The intermediate transfer belt 7 is formed into an endless form by using a film having a thickness of approximately 100 μm to 150 μm, for example.

The toner images are transferred from the photoconductor drum 3 to the intermediate transfer belt 7 by means of the intermediate transfer roller 6 that is in contact with an inside surface of the intermediate transfer belt 7. A transfer bias having a high voltage (high voltage having a polarity (+) reverse to a charge polarity (−) of the toner) is applied to the intermediate transfer roller 6 in order to transfer the toner images.

The intermediate transfer roller 6 is formed with a metal (for example, stainless steel) shaft having a diameter of, for example, 8 mm to 10 mm as a base, and the surface thereof is covered with an elastic material having conductivity (for example, EPDM or urethane foam). The conductive elastic material enables the intermediate transfer roller 6 to uniformly apply a high voltage to the intermediate transfer belt 7. In the present embodiment, a roller type transfer electrode (intermediate transfer roller 6) is used. Alternatively, a brush type transfer electrode or the like may be used.

As described above, the electrostatic latent images on the photoconductor drum 3 are individually made visible with the toners corresponding to the respective color components to be toner images. The toner images are superimposed on the intermediate transfer belt 7. The superimposed toner images are moved by rotation of the intermediate transfer belt 7 to a contact position (transfer part) between the intermediate transfer belt 7 and a paper sheet that has been conveyed to this position, and transferred onto the paper sheet by a transfer roller 11 disposed at this position. Here, while the intermediate transfer belt 7 and the transfer roller 11 are being pressed against each other at a predefined nip, a voltage is applied to the transfer roller 11 for transferring the toner images to the paper. This voltage is a high voltage having a polarity (+) reverse to a charge polarity (−) of the toner.

In order to steadily obtain the nip, one of the transfer roller 11 and the intermediate transfer belt driving roller 71 is formed from a hard material such as a metal, and the other is formed from a flexible material such as the case with an elastic roller (for example, elastic rubber roller or formable resin roller).

Toners adhering to the intermediate transfer belt 7 due to the contact between the intermediate transfer belt 7 and the photoconductor drum 3; and toners that have not been transferred upon the transfer of the toner images from the intermediate transfer belt 7 to the paper sheet and that are remaining on the intermediate transfer belt 7 cause color mixture of the toners in a following process. Such toners are therefore removed and collected by the intermediate transfer belt cleaning unit 9.

The intermediate transfer belt cleaning unit 9 includes a cleaning blade (cleaning member) that is in contact with the intermediate transfer belt 7. The contact part of the intermediate transfer belt 7 with the cleaning blade is supported from a back side by the intermediate transfer belt driven roller 72.

The developing device housing 100A further includes: a sheet feed tray 10 disposed in a lowermost part of the developing device housing 100A for storing a plurality of recording media; a manual sheet feed tray 20 disposed on one side surface of the developing device housing 100A for receiving an irregular-size recording medium; and a sheet conveyance path S through which a recording medium is conveyed to the intermediate transfer belt unit (transfer device) 8 from the sheet feed tray 10 or the manual sheet feed tray 20.

The sheet conveyance path S guides a sheet from the sheet feed tray 10 and a recording medium from the manual sheet feed tray 20 to the sheet exit tray 15 via the transfer part and the fuser unit 12. The transfer part is located between the intermediate transfer belt driving roller 71 and the transfer roller 11.

Further, pickup rollers 16*a* and 16*b*, conveyance rollers 25*a* to 25*f*, a registration roller 14, the transfer part (transfer roller 11) and the fuser unit 12 are disposed along the sheet conveyance path S.

The conveyance rollers 25*a* to 25*f* are small-size rollers provided along the sheet conveyance path S for facilitating and assisting the sheet conveyance. The pickup roller 16*a* is a pull-in roller provided at an end of the sheet feed tray 10 for feeding sheets from the sheet feed tray 10 to the sheet conveyance path S one by one. The pickup roller 16*b* is a pull-in roller provided in the vicinity of the manual sheet feed tray 20 for feeding sheets from the manual sheet feed tray 20 to the sheet conveyance path S one by one. The registration roller 14 is to temporarily hold a seat being conveyed through the sheet conveyance path S and convey the sheet to the transfer part in such a timely manner that a front end of the toner images on the intermediate transfer belt 7 and a front end of the sheet coincide.

[Configuration of Fuser Housing 100B]

As illustrated in FIG. 1, the fuser (fixing device) 12 accommodated in the fuser housing 100B includes: a heat roller 81 and a pressure roller 82 that rotate in directions opposite to each other while holding therebetween a recording medium having a toner image transferred thereto; the conveyance roller 25*b*; and the sheet ejection roller 25*c*.

The heat roller 81 is controlled by a controller, not shown, so as to be at a predetermined fusing temperature. The controller controls the temperature of the heat roller 81 based on a detection signal from a temperature detector, not shown.

The heat roller 81 having reached the fusing temperature and the pressure roller 82 are pressed against the recording medium to melt the toners, thereby fusing the toner image on the recording medium.

The recording medium having the toner image fused thereon is conveyed by the conveyance rollers 25*b* and 25*c* to a reverse sheet ejection path of the sheet conveyance path S, and ejected onto the sheet exit tray 15 with being reversed (i.e., with the toner image facing down).

[Configuration of Developing Device 2]

Figure 2:
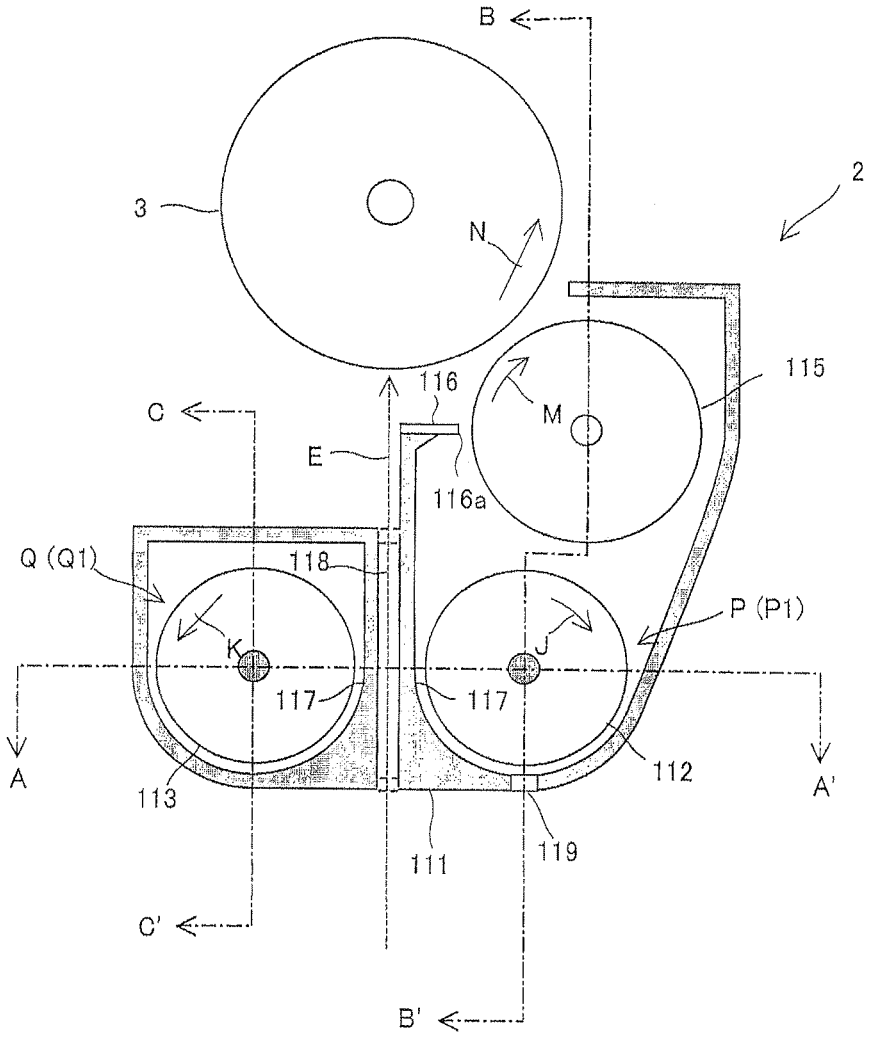
FIG. 2 is a sectional view of a developing device in the image forming apparatus illustrated in FIG. 1.
Figure 3:
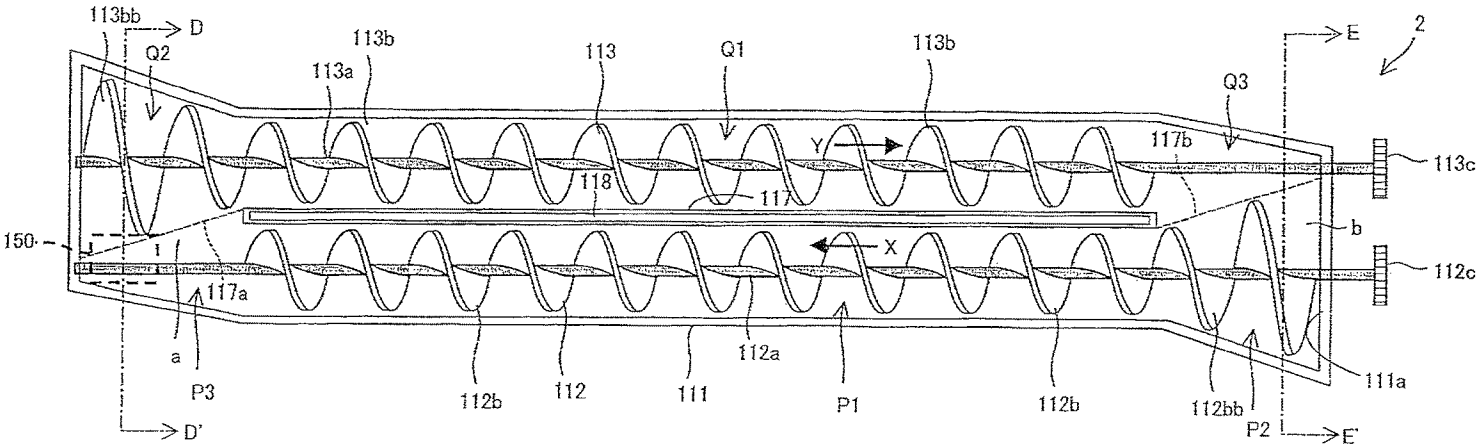
FIG. 3 is a sectional view of the developing device taken along a line A-A' in FIG. 2.
Figure 4:
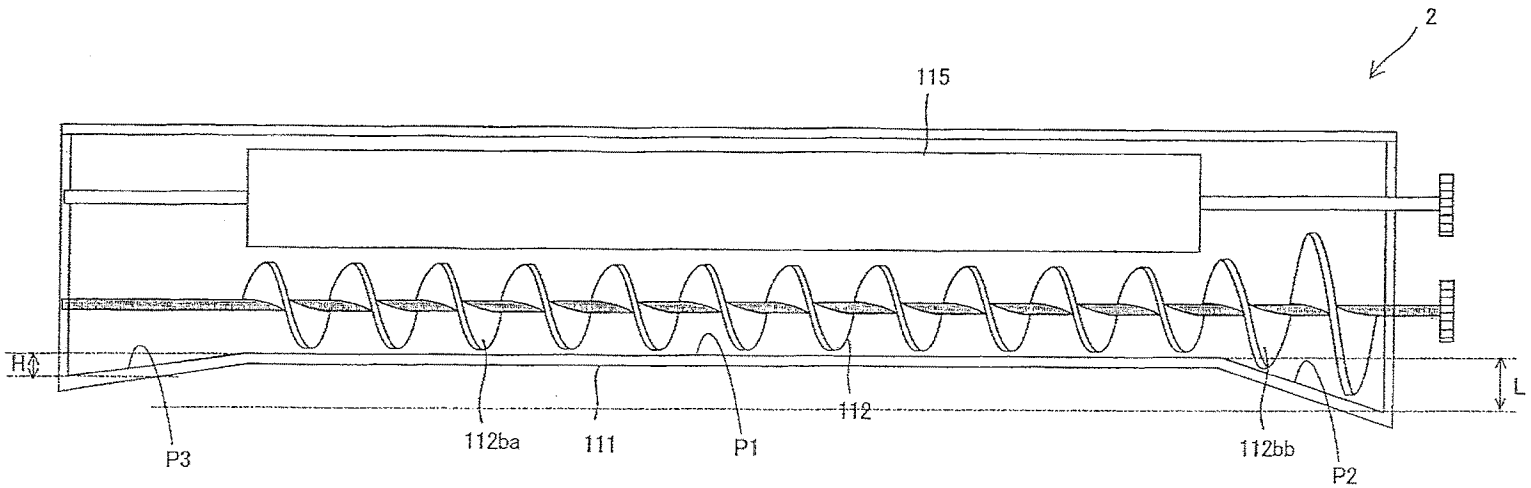
FIG. 4 is a sectional view of the developing device taken along a line B-B' in FIG. 2.
Figure 5:
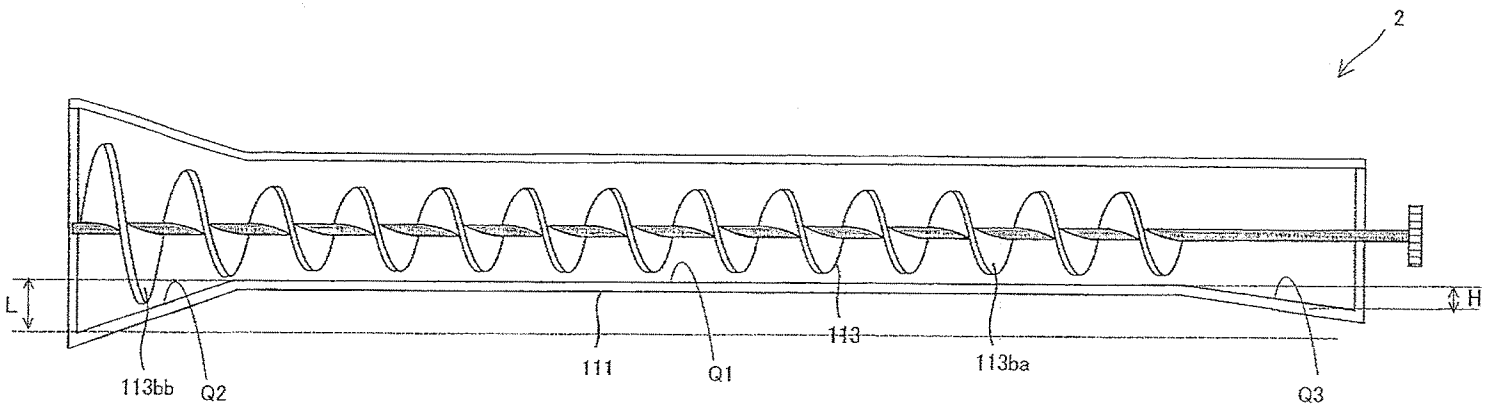
FIG. 5 is a sectional view of the developing device taken along a line C-C' in FIG. 2.
Figure 6:
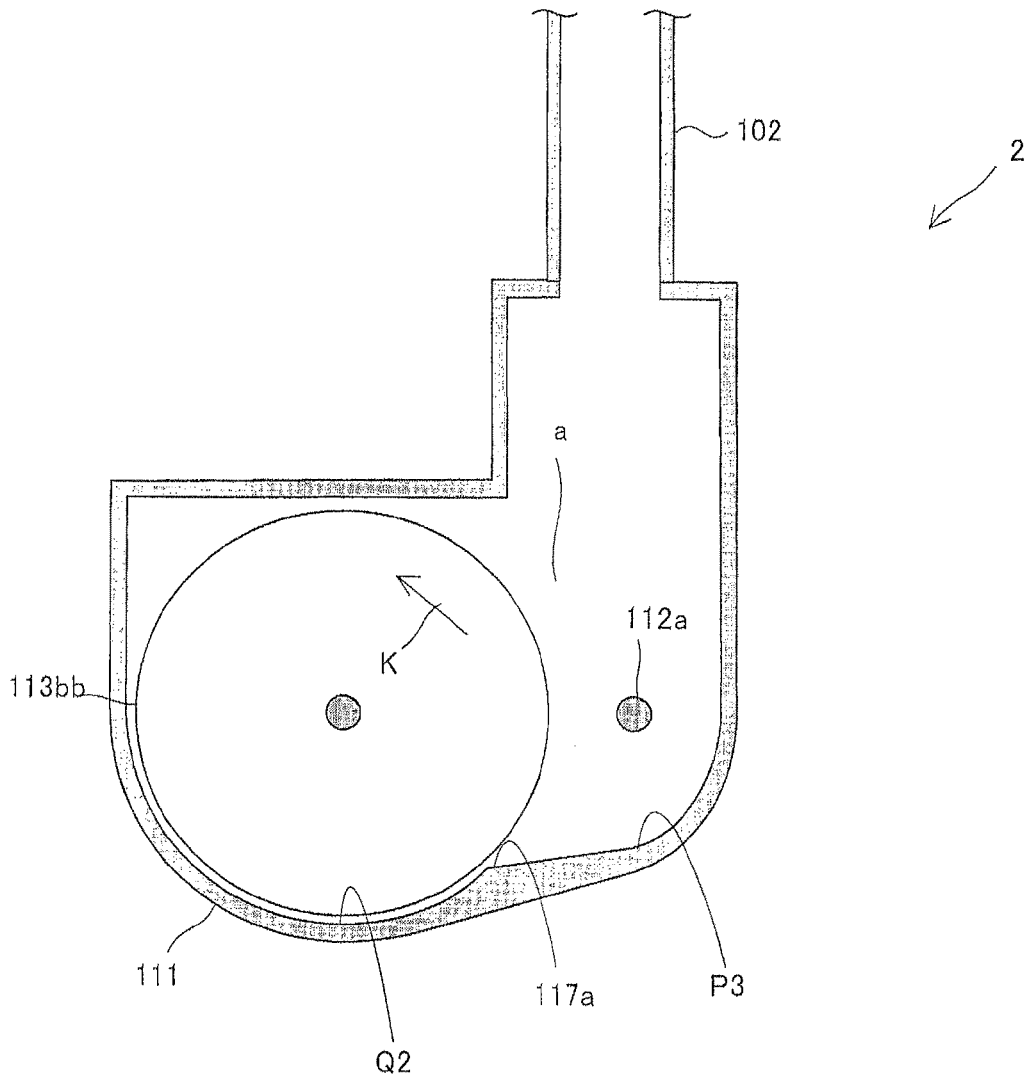
FIG. 6 is a sectional view taken along a line D-D' in FIG. 3.
Figure 7:
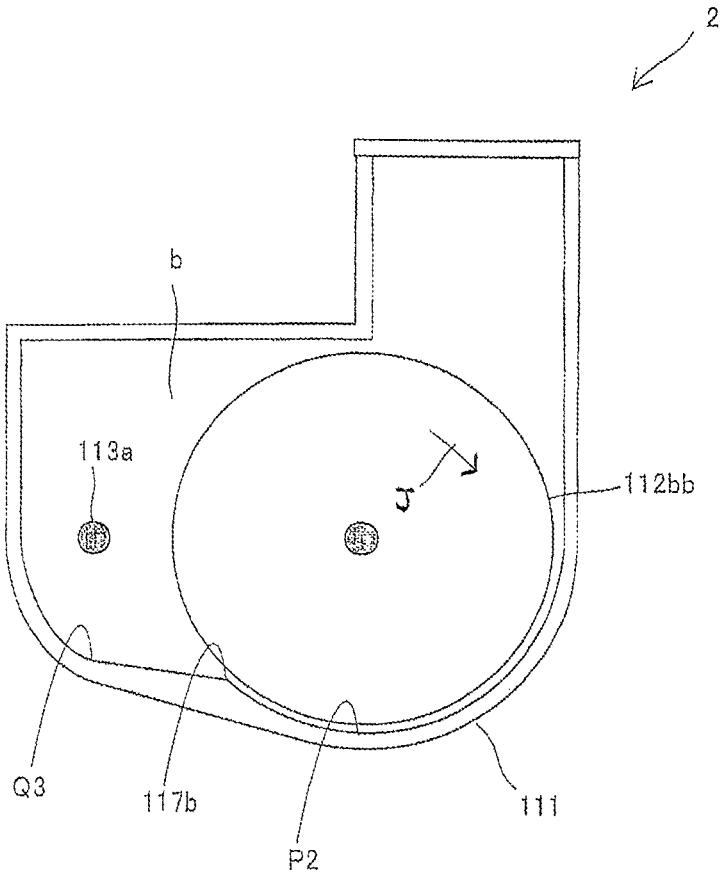
FIG. 7 is a sectional view taken along a line E-E' in FIG. 3.

FIG. 2 is a sectional view illustrating an embodiment of the developing device 2 illustrated in FIG. 1. FIG. 3 is a sectional view taken along a line A-A' in FIG. 2; FIG. 4 is a sectional view taken along a line B-B' in FIG. 2; FIG. 5 is a sectional view taken along a line C-C' in FIG. 2; FIG. 6 is a sectional view taken along a line D-D' in FIG. 3; and FIG. 7 is a sectional view taken along a line E-E' in FIG. 3. In these drawings, a developer stored in a developer tank 111 is not shown.

The developing device 2 has, in the developer tank 111, a developing roller 115 disposed so as to oppose the photoconductor drum 3. The developing device 2 supplies a toner to the surface of the photoconductor drum 3 by means of the developing roller 115 to develop (make visible) an electrostatic latent image formed on the surface of the photoconductor drum 3.

As illustrated in FIG. 2, the developing device 2 includes the developer tank 111, the developing roller 115 for supplying the two-component developer to the photoconductor drum 3, a partition 117, developer conveyance members (112 and 113), a doctor blade 116 and a toner concentration detection sensor 119.

The developer tank 111 stores a developer including a toner and a magnetic carrier (two-component developer).

In the developer tank 111, the developing roller 115, the first conveyance member 112, the second conveyance member 113, the doctor blade 116 and the toner concentration detection sensor 119 are arranged at positions as illustrated in FIG. 2.

The carrier included in the developer usable for the present invention is a magnetic carrier having magnetism such as, for example, a ferrite carrier.

<Internal Configuration of Developer Tank>

In FIG. 2, the internal space of the developer tank 111 is divided into two chambers lying side by side in the horizontal direction by the partition 117 elongated in a direction parallel to the axial direction of the developing roller 115 (direction perpendicular to the surface of the page of FIG. 2). Of the two chambers, the right chamber is a first developer conveyance path P, and the left chamber IS a second developer conveyance path Q.

These two conveyance paths (P and Q) convey and circulate the two-component developer in pairs.

As illustrated in FIG. 2, the partition 117 includes therein a light guide path 118 for guiding light E emitted from the exposure device 1 to the surface of the photoconductor drum. The light guide path 118 is a hollow space penetrating the inside of the partition 117 in the vertical direction.

The light E enters from a lower end of the hollow space being the light guide path 118, goes straight upward in the hollow space, and then applied to the surface of the photoconductor drum 3.

As illustrated in FIG. 1, the light E in FIG. 2 is emitted from the exposure unit 1 to be reflected upward by the mirrors of the exposure unit 1 and applied to the photoconductor drum 3 through the light guide path 118 of the developing device 2.

As illustrated in FIG. 2, the light guide path 118 is a space penetrating the inside of the partition 117 in the vertical direction. Preferably, as illustrated in FIG. 3, the space is elongated also in a direction parallel to the rotation axes of the first conveyance member 112 and the second conveyance member 113 (longer direction of the surface of the page of FIG. 3).

In addition, as illustrated in FIG. 3, the first developer conveyance path P and the second developer conveyance path Q are long and narrow paths lying side by side which convey the developer in opposite directions and have a first communicating path a for guiding the two-component developer at the downstream side (left end in FIG. 3) in the first developer conveyance path P to the second developer conveyance path Q and a second communicating path b for guiding the two-component developer at the downstream side (right end in FIG. 3) in the second developer conveyance path Q to the first developer conveyance path P.

<Description of First Developer Conveyance Path>

As illustrated in FIGS. 3 and 4, the first developer conveyance path P has three sections: a central section P1, an upstream side end section P2 and a downstream side end section P3. The upstream side end section P2 corresponds to the above-described first upstream side end section, and the downstream side end section P3 corresponds to the above-described first downstream side end section.

The central section P1 is in a semi-cylindrical shape whose bottom has a semicircular cross section as illustrated in FIG. 2. The central section P1 has a length almost the same as the partition 117 as illustrated in FIG. 3.

The central section P1 contains the first conveyance member 112 separated from its inner wall and the partition 117 by predetermined gaps. FIG. 2 shows a cross section of the central section P1. The first developer conveyance path P and the second developer conveyance path Q are completely separated by the partition 117 in the central section P1, and the bottoms of the two conveyance paths (P and Q) are at the same level in the vertical direction.

The upstream side end section P2 of the first developer conveyance path P is an area at the right end in FIG. 3, formed at a position facing the second communicating path b. The central section P1 is provided with the partition 117 at a constant height to completely separate the two conveyance paths (P and Q), whereas the upstream side end section P2 is not provided with the partition 117 to allow the developer to move from the second developer conveyance path Q toward the first developer conveyance path P.

As illustrated in FIGS. 3 and 4, the upstream side end section P2 is formed into a conical shape having an inner diameter conically increasing toward a right side wall 111*a* of the developer tank 111 (upstream side of the two-component developer conveyance direction) from the right end of the central section P1 in the vicinity of the second communicating path b.

That is, the upstream side end section P2 is a space in a conical shape expanding toward the right side wall 111*a* of the developer tank 111 and having a bottom inclining downward in the vertical direction as illustrated in FIG. 4. For example, the bottom of the upstream side end section P2 in the vicinity of the right side wall 111*a* is at a level lower than the bottom of the central section P1 by a length L. The length L is approximately 15 mm, for example.

In the upstream side end section P2, as described later, the helical blade of the first conveyance member 112 has a conical helix portion 112*bb* having an outer diameter progressively increasing along the inner wall surface of the bottom of the upstream side end section P2.

The downstream side end section P3 of the first developer conveyance path P is an area at the left end in FIG. 3, formed at a position facing the first communicating path a. The downstream side end section P3 is not provided with the partition 117 to allow the developer to move from the first developer conveyance path P toward the second developer conveyance path Q.

As illustrated in FIG. 3, the downstream side end section P3 is in a conical shape having an inner diameter conically decreasing toward a left side wall of the developer tank 111 from the left end of the central section P1, except for the bottom in the vertical direction.

As illustrated in FIG. 4, the bottom of the downstream side end section P3 in the vertical direction has a downslope from the left end of the central section P1 of the first developer conveyance path P in the vicinity of the first communicating path a toward the left side wall of the developer tank 111 (downstream side of the two-component developer conveyance direction) in the direction of the rotation axis of the first conveyance member.

That is, the bottom is in a shape inclining downward in the vertical direction and at a level lower than the bottom of the central section P1 by a length H in the vicinity of the left side wall of the developer tank 111. The length H is approximately 5 mm, for example.

As illustrated in FIG. 6, the downstream side end section P3 has, at a position facing the first communicating path a, a downslope from the first developer conveyance path P toward the second developer conveyance path Q in a direction perpendicular to the rotation axis of the first conveyance member.

At the position facing the first communicating path a as illustrated in FIG. 6, therefore, the bottom of the upstream side end section Q2 of the second developer conveyance path Q in the vertical direction is configured to be at a level lower than the bottom of the downstream side end section P3 of the first developer conveyance path P in the vertical direction.

Since the bottom of the upstream side end section Q2 of the second developer conveyance path Q is at a level lower than the bottom of the downstream side end section P3 of the first developer conveyance path P in the vertical direction as described above, the developer can flow smoothly from the first developer conveyance path P into the second developer conveyance path Q through the first communicating path a. Accordingly, the smooth flow of the developer in the vicinity of the first communicating path a allows reduction of stay of the two-component developer and stress on the two-component developer.

Having the downslope, the downstream side end section P3 does not need the blade of the first conveyance member 112 for urging the two-component developer.

Further, since the downstream side end section P3 of the first developer conveyance path P has the downslope toward the left side wall of the developer tank in the direction of the rotation axis of the first conveyance member, the two-component developer that has been conveyed to the downstream side end section P3 of the first developer conveyance path P can easily move toward the left side wall of the developer tank to be prevented from staying at the downstream side end section P3 of the first developer conveyance path P.

As described above, the developing device of the present invention has the following characteristic configurations in the vicinity of the first communicating path a.

(1) The bottom of the upstream side end section Q2 is at a level lower than the bottom of the downstream side end section P3.

(2) The downstream side end section P3 has a downslope toward a side wall of the developer tank in the direction of the rotation axis of the first conveyance member.

(3) The downstream side end section P3 has a downslope from the first developer conveyance path P toward the second developer conveyance path Q in the direction perpendicular to the rotation axis of the first conveyance member.

The characteristic configurations allow improvement of the flow of the two-component developer and reduction of stay of the developer and stress on the developer in the vicinity of the first communicating path a, which is the downstream side of the first developer conveyance path.

<Description of Second Developer Conveyance Path>

As illustrated in FIGS. 3 and 5, the second developer conveyance path Q has three sections: a central section Q 1, an upstream side end section Q2 and a downstream side end section Q3. The upstream side end section Q2 corresponds to the above-described second upstream side end section, and the downstream side end section Q3 corresponds to the above-described second downstream side end section.

The central section Q1 is in a semi-cylindrical shape whose bottom has a semicircular cross section as illustrated in FIG. 2. The central section Q1 has a length almost the same as the partition 117 as illustrated in FIG. 3.

The central section Q1 contains the second conveyance member 113 separated from its inner wall and the partition 117 by predetermined gaps. FIG. 5 illustrates a cross section of the central section Q1.

The upstream side end section Q2 of the second developer conveyance path Q is an area at the left end in FIG. 3, formed at a position facing the first communicating path a. The partition 117 for the boundary between the upstream side end section Q2 and the downstream side end section P3 has a lower height than the partition 117 for the central section Q1 as described above.

As illustrated in FIGS. 3 and 5, the upstream side end section Q2 is formed into a conical shape having an inner diameter conically increasing toward the left side wall of the developer tank 111 (upstream side of the two-component developer conveyance direction) from the left end of the central section Q1 in the vicinity of the first communicating path a.

That is, the upstream side end section Q2 has the same shape as the upstream side end section P2 of the first developer conveyance path P.

As illustrated in FIG. 5, the upstream side end section Q2 is a space in a conical shape expanding toward the left side wall of the developer tank 111 and having a bottom inclining downward in the vertical direction. For example, as in the case of the upstream side end section P2 of the first developer conveyance path P, the bottom in the vicinity of the left side wall is at a level lower than the bottom of the central section Q1 by the length L (=approximately 15 mm).

In the upstream side end section. Q2, the helical blade of the second conveyance member 113 has a conical helix portion 113*bb* having an outer diameter progressively increasing along the inner wall surface of the bottom of the upstream side end section Q2.

The downstream side end section Q3 of the second developer conveyance path Q is an area at the right end in FIG. 3, formed at a position facing the second communicating path b. As in the case of the downstream side end section P3 of the first developer conveyance path P described above, the partition 117 for the downstream side end section Q3 has a lower height than the partition 117 for the central section Q1.

As illustrated in FIG. 3, the downstream side end section Q3 is in a conical shape having an inner diameter conically decreasing toward the right side wall 111*a* of the developer tank 111 from the right end of the central section Q1, except for the bottom in the vertical direction.

As illustrated in FIG. 5, the bottom of the downstream side end section Q3 in the vertical direction has a downslope from the right end of the central section Q1 of the second developer conveyance path Q in the vicinity of the second communicating path b toward the right side wall of the developer tank 111 (downstream side of the two-component developer conveyance direction) in the direction of the rotation axis of the second conveyance member. That is, the bottom is in a shape inclining downward in the vertical direction and at a level lower than the bottom of the central section Q1 by the length H (=approximately 5 mm) in the vicinity of the right side wall of the developer tank.

Since the downstream side end section Q3 of the second developer conveyance path Q has the downslope toward the right side wall of the developer tank in the direction of the rotation axis of the second conveyance member, the two-component developer that has been conveyed to the downstream side end section Q3 can easily move toward the right side wall of the developer tank to be prevented from staying at the downstream side of the second developer conveyance path Q.

As illustrated in FIG. 7, the downstream side end section Q3 of the second developer conveyance path Q has a downslope from the second developer conveyance path Q toward the first developer conveyance path P in a direction perpendicular to the rotation axis of the second conveyance member.

At a position facing the second communicating path b as illustrated in FIG. 7, therefore, the bottom of the upstream side end section P2 of the first developer conveyance path P in the vertical direction is configured to be at a level lower than the bottom of the downstream side end section Q3 of the second developer conveyance path Q in the vertical direction.

Since the bottom of the upstream side end section P2 of the first developer conveyance path P is at a level lower than the bottom of the downstream side end section Q3 of the second developer conveyance path Q as described above, the developer can flow smoothly from the second developer conveyance path Q into the first developer conveyance path P through the second communicating path b.

Having the downslope, the downstream side end section Q3 does not need the blade of the second conveyance member 113 for urging the two-component developer.

As described above, the developing device of the present invention has the following characteristic configurations in the vicinity of the second communicating path b.

(4) The bottom of the upstream side end section P2 is at a level lower than the bottom of the downstream side end section Q3.

(2) The downstream side end section Q3 has a downslope toward a side wall of the developer tank in the direction of the rotation axis of the second conveyance member.

(3) The downstream side end section Q3 has a downslope from the second developer conveyance path Q toward the first developer conveyance path P in the direction perpendicular to the rotation axis of the second conveyance member.

The characteristic configurations allow improvement of the flow of the two-component developer and reduction of stay of the developer and stress on the developer in the vicinity of the second communicating path b, which is the downstream side of the second developer conveyance path.

In addition, as illustrated in FIG. 6, a downslope from the bottom of the downstream side end section P3 of the first developer conveyance path P toward the bottom of the upstream side end section Q2 of the second developer conveyance path Q may be provided in the vicinity of the first communicating path a, and a first developer maximum point 117*a* may be provided at a boundary between the two conveyance paths (P3 and Q2) to the extent that the flow of the developer in the direction of the downslope is not blocked. The two-component developer in the second developer conveyance path Q is thereby prevented from flowing backward into the first developer conveyance path P to achieve efficient conveyance of the two-component developer.

Further, as illustrated in FIG. 7, a downslope from the bottom of the downstream side end section Q3 of the second developer conveyance path Q toward the bottom of the upstream side end section P2 of the first developer conveyance path P may be provided in the vicinity of the second communicating path b, and a second developer maximum point 117*b* may be provided at a boundary between the two conveyance paths (Q3 and P2) to the extent that the flow of the developer in the direction of the downslope is not blocked. The two-component developer in the first developer conveyance path P is thereby prevented from flowing backward into the second developer conveyance path Q to achieve efficient conveyance of the two-component developer.

<Description of First Conveyance Member>

As illustrated in FIG. 3, the first conveyance member 112 includes a first rotation axis 112*a* and a first helical conveyance blade 112*b* fixed to the first rotation axis 112*a* to integrally rotate. The first conveyance member 112 also includes a first gear 112*c* at one end of the rotation axis 112*a* that penetrates the side wall 111*a* on one side of the longitudinal direction of the developer tank 111.

As illustrated in FIG. 4, the first conveyance blade 112*b* has a first helical blade portion 112*ba* having a constant outer diameter and the first conical helix portion 112*bb* having an outer diameter conically increasing from the central section P1 toward the right end of FIG. 4 (upstream side of the two-component developer conveyance direction).

The first conical helix portion 112*bb* has a helical blade whose outer diameter progressively increases along the inner wall surface of the bottom of the upstream side end section P2 of the first developer conveyance path P so as to be constantly separated from the inner wall surface by a predetermined gap.

When the first conveyance member 112 is driven by drive means (motor, for example), not shown, via the first gear 112*c* to rotate in a direction of an arrow J (see FIG. 2), the two-component developer in the first developer conveyance path P is conveyed in a direction of an arrow X as illustrated in FIG. 3.

<Description of Second Conveyance Member>

As illustrated in FIG. 3, the second conveyance member 113 includes a second rotation axis 113*a* and a second helical conveyance blade 113*b* fixed to the second rotation axis 113*a* to integrally rotate. The second conveyance member 113 also includes a second gear 113*c* at one end of the rotation axis 113*a* that penetrates the side wall 111*a* on one side of the longitudinal direction of the developer tank 111.

As illustrated in FIG. 5, the second conveyance blade 113*b* has a second helical blade portion 113*ba* having a constant outer diameter and the second conical helix portion 113*bb* having an outer diameter conically increasing from the central section Q1 toward the left end of FIG. 5 (upstream side of the two-component developer conveyance direction).

The second conical helix portion 113*bb* has a helical blade whose outer diameter progressively increases along the inner wall surface of the bottom of the upstream side end section Q2 of the second developer conveyance path Q so as to be constantly separated from the inner wall surface by a predetermined gap.

When the second conveyance member 113 is driven by drive means (motor, for example), not shown, via the second gear 113*c* to rotate in a direction of an arrow K (see FIG. 2), the two-component developer in the second developer conveyance path Q is conveyed in a direction of an arrow Y as illustrated in FIG. 3.

<Developing Roller>

As illustrated in FIG. 2, the developer tank 111 has an opening at an upper part of the first developer conveyance path P. In the opening, the developing roller 115 is rotatably disposed so as to have a predetermined development nip part between the developing roller 115 and the photoconductor drum 3.

The developing roller 115 is a magnet roller to be driven by drive means, not shown, to rotate about its axis in a direction of an arrow M for bearing and supplying the two-component developer in the first developer conveyance path P to the photoconductor drum 3 that rotates in a direction of an arrow N.

A development bias voltage is applied from a power supply, not shown, to cause toner to adhere to an electrostatic latent image on the surface of the photoconductor drum 3 to develop the image.

<Doctor Blade>

As illustrated in FIG. 2, the doctor blade 116 is a rectangular plate-like member extending in parallel with the axial direction of the developing roller 115. The doctor blade 116 is fixed to the developer tank 111 while keeping a predetermined gap between an end 116*a* thereof and the surface of the developing roller 115. Examples of the material of the doctor blade 116 include stainless steel, aluminum and synthetic resin.

<Toner Concentration Detection Sensor>

As illustrated in FIG. 2, the toner concentration detection sensor 119 is provided under the first conveyance member 112 in the vertical direction and at a position in the central section P1 of the first developer conveyance path P. The toner concentration detection sensor 119 is attached to a wall surface of the developer tank 111 that forms the first developer conveyance path P and provided so that its sensing surface is exposed on the inside of the first developer conveyance path P at a position where it contacts with the developer in the first developer conveyance path P.

The toner concentration detection sensor 119 is electrically connected to a toner concentration control unit, not shown.

The toner concentration control unit exerts control according to a toner concentration measurement value detected by the toner concentration detection sensor 119 so that a toner discharge member 122 of the toner supplying device 22 illustrated in FIG. 8 to be described later is driven to rotate and supply the toner from a toner discharge port 123 into the first developer conveyance path P of the developing device 2.

When the toner concentration control unit determines that the toner concentration measurement value detected by the toner concentration detection sensor 119 is lower than a predetermined value, a control signal is transmitted to drive means that rotationally drives the toner discharge member 122 to rotate the toner discharge member 122.

Examples of the toner concentration detection sensor 119 usable here include general toner concentration detection sensors such as a transmitted light detection sensor, a reflected light detection sensor and a magnetic permeability detection sensor. In particular, the magnetic permeability detection sensor is preferable in terms of sensitivity.

The magnetic permeability detection sensor (toner concentration detection sensor 119) is connected to a power supply, not shown.

The power supply applies a driving voltage to the magnetic permeability detection sensor to drive the magnetic permeability detection sensor. The power supply also applies a control voltage to the magnetic permeability detection sensor to output a toner concentration detection result to the toner concentration control unit. The voltage application to the magnetic permeability detection sensor from the power supply is controlled by the toner concentration control unit.

The magnetic permeability detection sensor outputs the toner concentration detection result as an output voltage value in response to the application of the control voltage. Since the magnetic permeability detection sensor has basically good sensitivity near a median value of the output voltage, a control voltage that can provide an output voltage around such a value is applied.

This type of magnetic permeability detection sensor is commercially available, and examples thereof include product names TS-L, TS-A and TS-K by TDK Corporation.

<Toner Supply Port>

As illustrated in FIG. 3, a toner supply port 150 for supplying a new toner to the first developer conveyance path P is provided in the vicinity of the first communicating path and at an upper part of the downstream side end section P3 (left end of FIG. 3) of the first developer conveyance path P in the vertical direction. The toner supply port 150 is provided at a downstream side of the two-component developer conveyance direction with respect to the toner concentration detection sensor 119 and at an upper part the downstream side end section P3 in the vertical direction in the vicinity of the first communicating path a.

According to this configuration, the developer in which the toner has been consumed and the toner concentration has been detected can be supplied with the new toner in an appropriate amount according to the detected concentration.

The new toner supplied through the toner supply port 150 is mixed with some of the two-component developer conveyed to be right under the toner supply port in the downstream side end section P3, and then conveyed to the upstream side end section Q2 of the second developer conveyance path.

Thereafter, the new toner is further mixed with the two-component developer that did not reach the left side wall of the developer tank and that has flowed into the second developer conveyance path Q through the first communicating path a.

That is, the new toner supplied will be mixed with the two-component developer in at least two steps. It is therefore possible to improve the miscibility between the supplementary toner and the two-component developer, and prevent the two-component developer from being conveyed while having the supplementary toner floating thereon.

As illustrated in FIGS. 3 and 6, the toner supply port 150 is connected to a toner conveyance pipe 102 illustrated in FIGS. 8 and 9 to be described later for guiding the supplementary toner.

[Configuration of Toner Supplying Device]

Figure 8:
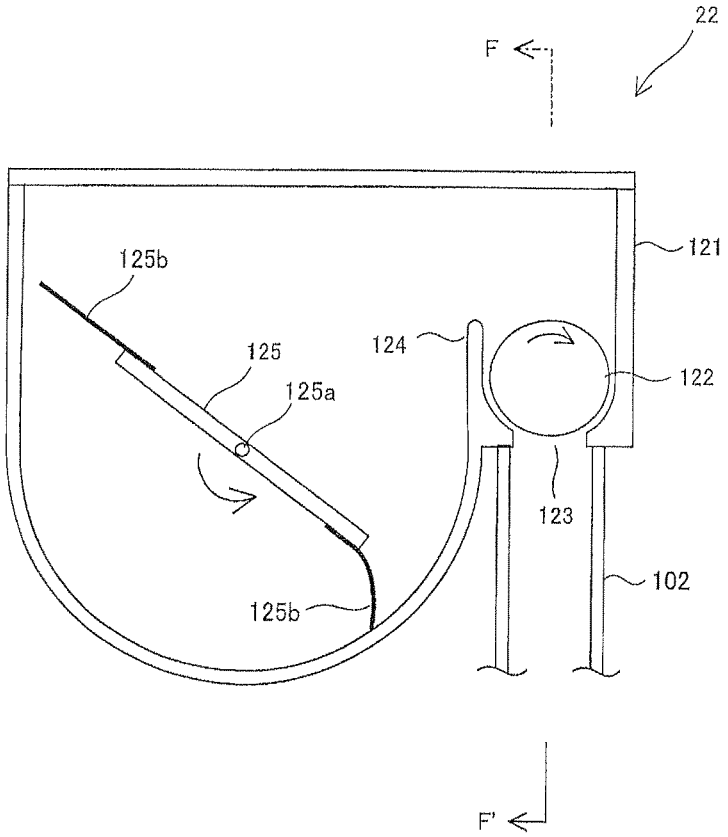
FIG. 8 is a schematic sectional view illustrating a configuration of an embodiment of a toner supplying device in a developing device of the present invention.

FIG. 8 is a schematic sectional view illustrating an embodiment of a toner supplying device in the developing device of the present invention. FIG. 9 is a sectional view of the toner supplying device illustrating a section around the toner discharge port taken along a line F-F' in FIG. 8.

Figure 9:
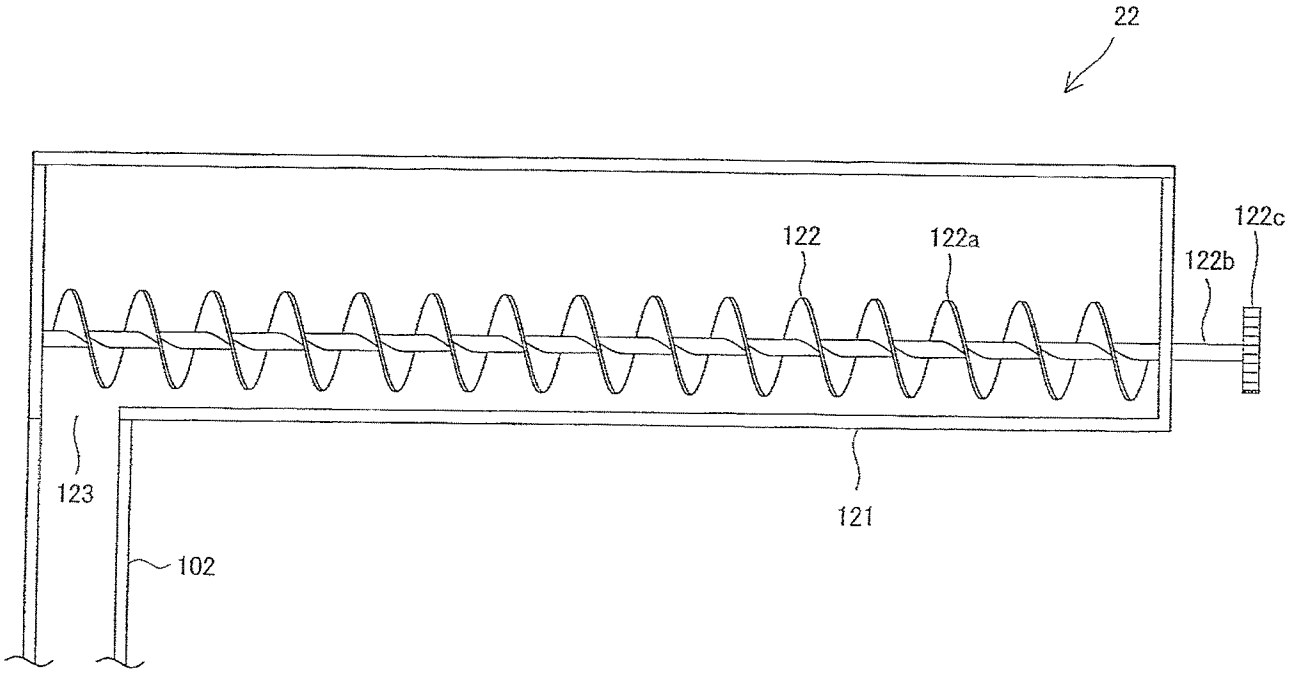
FIG. 9 is a sectional view of the toner supplying device taken along a line F-F' in FIG. 8.

As illustrated in FIGS. 8 and 9, the toner supplying device 22 includes a toner container 121 having the toner discharge port 123, a toner agitation member 125 and the toner discharge member 122, and accommodates unused toner therein.

As illustrated in FIG. 1, the toner supplying device 22 is disposed above the developer tank 111 of the developing device 2, and the toner discharge port 123 and the toner supply port 150 (see FIG. 3) of the developing device 2 are connected via the toner conveyance pipe 102. The toner container 121 is a substantially semi-cylindrical container member having an internal space, and the toner discharge port 123 is disposed at a lateral position in a circumferential direction of the semi-cylindrical part.

The toner agitation member 125 is rotatably disposed at a substantially central position in the semi-cylindrical part of the toner container 121, and the toner discharge member 122 is rotatably disposed above and near the toner discharge port 123.

The toner agitation member 125 is a plate-like member that rotates about a rotation axis 125*a*, and the toner agitation member 125 has sheet-like toner drawing members 125*b* made of flexible resin (for example, polyethylene terephthalate) at both leading ends away from the rotation axis 125*a*. The rotation axis 125*a* is rotatably supported on sidewalls on both sides in the longitudinal direction of the toner container 121, and one end of the rotation axis 125*a* penetrates the sidewall and has a gear fixed thereto and being in meshing engagement with a driving gear of drive means, not shown.

Upward rotation of the toner drawing members 125*b* with respect to the toner discharge port 123 allows the toner agitation member 125 to simultaneously agitate and draw the toner stored in the toner container 121 to convey the toner to the toner discharge member 122.

On this occasion, the toner drawing members 125*b* rotate to supply the toner to the side of the toner discharge member 122 while sliding along the inside wall of the toner container 121 and being deformed due to its flexibility.

The toner discharge member 122 and the toner agitation member 125 have a partition 124 therebetween. Thereby, an appropriate amount of toner drawn by the toner agitation member 125 can be held around the toner discharge member 122.

The toner discharge member 122 supplies the toner in the toner container 121 to the developer tank 111 through the toner discharge port 123. As illustrated in FIG. 9, the toner discharge member 122 includes a rotation axis 122*b* whose both ends are rotatably supported on sidewalls on both sides in the longitudinal direction of the toner container 121, a helical blade 122*a* fixed to the outer circumferential surface of the rotation axis 122*b* and a gear 122*c* fixed to the rotation axis 122*b* at one end that penetrates the sidewall of the toner container 121. The gear 122*c* is in meshing engagement with a driving gear of driving means, not shown.

The toner discharge port 123 of the toner container 121 is disposed at one end side of the helical blade 122*a* opposite to the side of the gear 122*c*.

Rotation of the toner discharge member 122 allows the toner supplied around the toner discharge member 122 to be conveyed by the helical blade 122*a* toward the toner discharge port 123 and to be supplied from the toner discharge port 123 into the developer tank 111 of the developing device 2 through the toner conveyance pipe 102.

<Description of Actions for Conveying Developer by Developing Device>

In a developing step with the image forming apparatus, as illustrated in FIGS. 2 to 7, the developing roller 115, the first conveyance member 112 and the second conveyance member 113 of the developing device 2 are rotated in the directions of the arrows M, J and K in FIG. 2, respectively.

As a result of the rotation of these members, the first conveyance blade 112*b* of the first conveyance member 112 conveys the developer present in the first developer conveyance path P in the direction of the arrow X in FIG. 3. At the same time, the second conveyance member 113 conveys the developer in the second developer conveyance path Q in the direction of the arrow Y in FIG. 3.

During the conveyance, the developer conveyed to the downstream side of the first developer conveyance path P is sent to the second developer conveyance path Q through the first communicating path a shown in FIG. 3, and the developer conveyed to the downstream side of the second developer conveyance path Q is sent to the first developer conveyance path P through the second communicating path b.

Some of the developer moved in the first developer conveyance path P is supplied to the developing roller 115. The developer supplied to the developing roller 115 is formed into a developer layer having a predetermined uniform thickness on the outer circumferential surface of the developing roller 115 and sent to the photoconductor drum 3 by the doctor blade 116. From the developer layer, some of the toner is supplied to the photoconductor drum 3.

After an electrostatic latent image on the photoconductor drum 3 is developed, the developer left on the surface of the developing roller 115 falls off into the first developer conveyance path P.

The toner concentration of the developer is detected by the toner concentration detection sensor 119. When the toner concentration in the first developer conveyance path P falls to a predetermined value, therefore, unused and new toner is supplied from the toner supplying device 22 onto the developer in the first developer conveyance path.

Thus, the two-component developer having a lowered toner concentration in the first developer conveyance path will be supplied with the new toner in the vicinity of the first communicating path a.

Having a slope inclining downward in the vertical direction from the downstream side end section of the first developer conveyance path P toward the upstream side end section of the second developer conveyance path Q, in particular, the present invention can convey the two-component developer toward the second developer conveyance path Q smoothly in the vicinity of the first communicating path a. Since the flow of the two-component developer is thus improved, it is possible to reduce stay of the two-component developer and stress on the two-component developer around the first communicating path.

Having another slope likewise inclining in the vertical direction between the two conveyance paths, the present invention can convey the two-component developer smoothly and reduce stay of the two-component developer and stress on the two-component developer also in the vicinity of the second communicating path b.

According to the present invention, the bottom of the second upstream side end section of the second developer conveyance path is at a level lower than the bottom of the first developer conveyance path in the vertical direction at a position facing the first communicating path, and therefore the developer that has been conveyed to the downstream side of the first developer conveyance path whose bottom is at a higher level is caused to path through the first communicating path and swiftly flow into the second developer conveyance path whose bottom is at a lower level. It is thereby possible to improve the flow of the developer and reduce stay of the two-component developer and stress on the two-component developer around the first communicating path.

What is claimed is:

1. A developing device, comprising:

a developer tank for containing a two-component developer;

a partition for partitioning an internal space of the developer tank;

a first developer conveyance path and a second developer conveyance path separated by the partition and configured to convey and circulate the two-component developer in pairs;

a first conveyance member and a second conveyance member provided in the first and second developer conveyance paths, respectively, in a freely rotatable manner, the first and second conveyance members each having a helical blade for conveying the two-component developer in one direction;

a first communicating path for guiding the two-component developer in the first developer conveyance path to the second developer conveyance path;

a second communicating path for guiding the two-component developer in the second developer conveyance path to the first developer conveyance path;

a developing roller for bearing and supplying the two-component developer in the first developer conveyance path to a photoconductor drum; and a toner supply port for supplying new toner into the developer tank, wherein the second developer conveyance path includes a second developer conveyance path central section and a second developer conveyance path upstream side end section having a bottom in a conical shape having an inner diameter conically increasing toward an upstream side of a two-component developer conveyance direction from the second developer conveyance path central section in the vicinity of the first communicating path, the helical blade of the second conveyance member comprises, in the second developer conveyance path upstream side end section of the second conveyance path, a second conical helix portion having an outer diameter conically increasing along an inner wall surface of the bottom of the second developer conveyance path upstream side end section toward the upstream side of the two-component developer conveyance direction, the bottom of the second developer conveyance path upstream side end section is at a level lower than a bottom of the first developer conveyance path in the vertical direction at a position facing the first communicating path, and the first developer conveyance path comprises a first developer conveyance path central section and a first developer conveyance path downstream side end section having a downslope from the first developer conveyance path central section in the vicinity of the first communicating path toward a downstream side of the two-component developer conveyance direction in a direction of a rotation axis of the first conveyance member.

2. The developing device according to claim 1, wherein the first developer conveyance path downstream side end section comprises a downslope from the first developer conveyance path toward the second developer conveyance path in a direction perpendicular to the rotation axis of the first conveyance member.

3. The developing device according to claim 2, wherein the first developer conveyance path includes a first developer conveyance path upstream side end section having a bottom in a conical shape having an inner diameter conically increasing toward an upstream side of the two-component developer conveyance direction from the first central section in the vicinity of the second communicating path, the helical blade of the first conveyance member comprises a first conical helix portion having an outer diameter conically increasing along an inner wall surface of a bottom of the first developer conveyance path upstream side end section toward the upstream side of the two-component developer conveyance direction, and the bottom of the first developer conveyance path upstream side end section is at a level lower than a bottom of the second developer conveyance path in the vertical direction at a position facing the second communicating path.

4. The developing device according to claim 3, wherein the second developer conveyance path includes a second developer conveyance path downstream side end section having a downslope from the second developer conveyance path central section in the vicinity of the second communicating path toward a downstream side of the two-component developer conveyance direction in a direction of a rotation axis of the second conveyance member.

5. The developing device according to claim 4, wherein the second developer conveyance path downstream side end section comprises a downslope from the second developer conveyance path toward the first developer conveyance path in a direction perpendicular to the rotation axis of the second conveyance member.

6. The developing device according to claim 1, wherein the toner supply port is provided in the vicinity of the first communicating path and at an upper part of the first downstream side end section in the vertical direction.

7. An image forming apparatus comprising a developing device according to claim 1.

* * * * *